US010887678B2

(12) United States Patent
Miyata

(10) Patent No.: US 10,887,678 B2
(45) Date of Patent: Jan. 5, 2021

(54) LOUDSPEAKER APPARATUS

(71) Applicant: SONY CORPORATION, Tokyo (JP)

(72) Inventor: Kouji Miyata, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/912,084

(22) PCT Filed: Jul. 7, 2014

(86) PCT No.: PCT/JP2014/003578
§ 371 (c)(1),
(2) Date: Feb. 12, 2016

(87) PCT Pub. No.: WO2015/029303
PCT Pub. Date: Mar. 5, 2015

(65) Prior Publication Data

US 2016/0205464 A1 Jul. 14, 2016

(30) Foreign Application Priority Data

Aug. 30, 2013 (JP) ..... 2013-179637

(51) Int. Cl.

| | |
|---|---|
| ***H04R 1/02*** | (2006.01) |
| ***H04R 1/24*** | (2006.01) |
| ***H04R 3/12*** | (2006.01) |
| ***H04R 3/04*** | (2006.01) |
| ***H04R 1/26*** | (2006.01) |
| ***H04R 1/22*** | (2006.01) |
| *H04R 3/14* | (2006.01) |
| *H04R 1/40* | (2006.01) |

(52) U.S. Cl.
CPC ..... *H04R 1/02* (2013.01); *H04R 1/227* (2013.01); *H04R 1/24* (2013.01); *H04R 1/26* (2013.01); *H04R 3/04* (2013.01); *H04R 3/12* (2013.01); *H04R 1/403* (2013.01); *H04R 3/14* (2013.01); *H04R 2201/028* (2013.01); *H04R 2205/022* (2013.01)

(58) Field of Classification Search
CPC . H04R 1/403; H04R 1/26; H04R 3/04; H04R 1/24; H04R 2205/022
USPC ..... 381/336, 335, 99, 182, 186
See application file for complete search history.

(56) References Cited

U.S. PATENT DOCUMENTS

| | | | | |
|---|---|---|---|---|
| 4,229,619 A * | 10/1980 | Takahashi | H04R 3/02 330/109 |
| 4,284,844 A * | 8/1981 | Belles | H04R 1/2834 181/151 |
| 6,009,972 A * | 1/2000 | Choi | H04R 1/345 181/153 |
| 2004/0196982 A1 * | 10/2004 | Aylward | H04R 27/00 381/17 |

(Continued)

*Primary Examiner* — Alexander Krzystan
(74) *Attorney, Agent, or Firm* — Chip Law Group

(57) ABSTRACT

A loudspeaker apparatus includes a first loudspeaker unit and a second loudspeaker unit that reproduce sound at least at a high frequency. The first loudspeaker unit and the second loudspeaker unit are placed on a plane having an axis extending in a horizontal direction and an axis extending in a vertical direction. The first loudspeaker unit is placed so as to be directed horizontally forward. The second loudspeaker unit is placed so as to be directed vertically upward to make an approximately 90° angle with the first loudspeaker unit.

5 Claims, 11 Drawing Sheets

(56) References Cited

U.S. PATENT DOCUMENTS

| | | | | |
|---|---|---|---|---|
| 2005/0094829 | A1* | 5/2005 | Cordell | H04R 3/08 381/103 |
| 2005/0094830 | A1* | 5/2005 | Stanley | H04R 3/14 381/111 |
| 2006/0126878 | A1* | 6/2006 | Takumai | H04R 3/12 381/335 |
| 2007/0025559 | A1* | 2/2007 | Mihelich | H04S 7/301 381/59 |
| 2014/0126753 | A1* | 5/2014 | Takumai | H04S 7/305 381/303 |
| 2015/0304791 | A1* | 10/2015 | Crockett | H04R 1/26 381/307 |
| 2016/0330562 | A1* | 11/2016 | Crockett | G06F 3/162 |

* cited by examiner

A

B

A

B

LOUDSPEAKER APPARATUS

TECHNICAL FIELD

The present disclosure relates to a loudspeaker apparatus.

BACKGROUND ART

There has been proposed a loudspeaker apparatus including multiple loudspeaker units configured to reproduce sound (see Patent Literature 1 and 2 below, for example).

CITATION LIST

Patent Literature

Patent Literature 1: Japanese Unexamined Utility Model Application Publication No. H5-63194

Patent Literature 2: JP H3-24899A

SUMMARY OF INVENTION

Technical Problem

A common loudspeaker apparatus tends to reproduce sound reduced in directivity and having insufficient acoustic energy as the sound becomes higher pitched (comes to have higher frequencies). This leads to a smaller listening area at high frequencies, which is problematic.

Thus, an object of the present disclosure is to expand a listening area at high frequencies.

Solution to Problem

In order to solve the above problem, the present disclosure is, for example, a loudspeaker apparatus including: a first loudspeaker unit and a second loudspeaker unit that are configured to reproduce sound at least at a high frequency. The first loudspeaker unit and the second loudspeaker unit are placed on a plane having an axis extending in a horizontal direction and an axis extending in a vertical direction. The first loudspeaker unit is placed so as to be directed horizontally forward. The second loudspeaker unit is placed so as to be directed vertically upward to make an approximately 90° angle with the first loudspeaker unit. When a center of a diaphragm fixing face of the first loudspeaker unit is placed at an origin of the plane, and it is assumed that X represents a horizontally rearward direction and Y represents a vertically upward direction, the second loudspeaker unit is placed in a manner that coordinates of a center of a diaphragm fixing face of the second loudspeaker unit lie on a straight line represented by the following formula in the plane:

$$Y=-aX+b, \text{ where } a>0, b>0, X>0, \text{ and } Y>0. \quad \text{(Formula)}$$

Advantageous Effect of Invention

At least one embodiment enables expansion of a listening area for high frequency sound. Note that the effects of the present disclosure should not necessarily be limited to the effect described above, but may include any effect described herein. Note also that the subject matter of the present disclosure should not be interpreted as limited by the exemplary effects in the following description.

DESCRIPTION OF EMBODIMENTS

Hereinafter, multiple embodiments according to the present disclosure will be described with reference to the drawings. The description will be given in the following order.

<1. First Embodiment>

<2. Second Embodiment>

<3. Modification>

The embodiments and the like to be described below are preferred specific examples of the present disclosure. Accordingly, these embodiments and the like do not limit the subject matter of the present disclosure at all.

Note that, in the following description, a loudspeaker apparatus will be assumed to be placed on a predetermined flat surface, and forward (frontward) in a horizontal direction (direction parallel to the predetermined flat surface) of the loudspeaker apparatus will be referred to as horizontally forward as appropriate while rearward in a horizontal direction of the loudspeaker apparatus, that is, the depth direction of the loudspeaker apparatus, will be referred to as horizontally rearward as appropriate. In addition, upward in a vertical direction, which is perpendicular to the horizontal direction, of the loudspeaker apparatus will be referred to as vertical(ly) upward as appropriate while downward in a vertical direction of the loudspeaker apparatus will be referred to as vertical(ly) downward as appropriate. The definitions of these directions are just for the purpose of illustrating the relative positional relation between a first loudspeaker unit and a second loudspeaker unit to be described later. Accordingly, these directions do not limit the subject matter of the present disclosure at all. The predetermined flat surface on which the loudspeaker is placed is not limited to a horizontal surface, but may be an inclined surface, for example.

1. First Embodiment

"Exemplary Appearance of Loudspeaker Apparatus"

Figure 1:
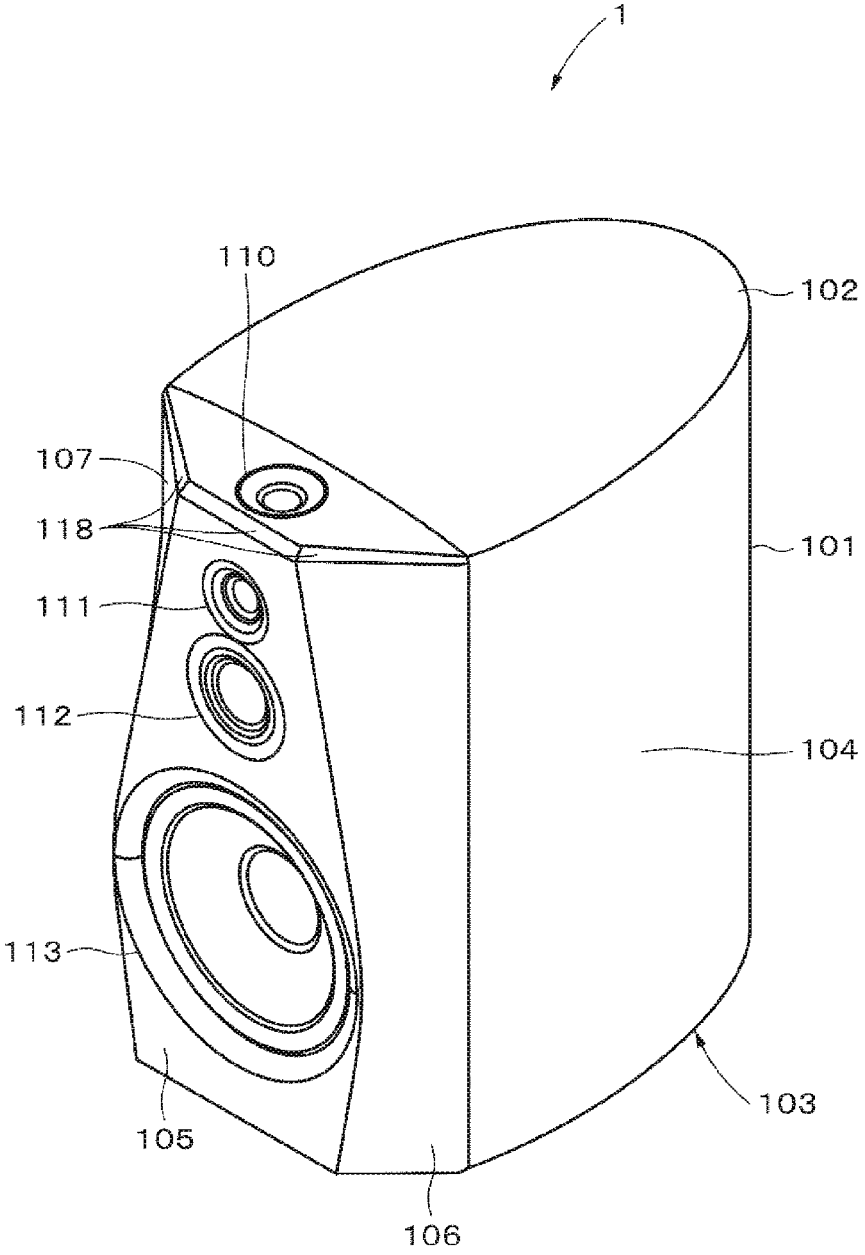
FIG. 1 is a perspective view showing an exemplary appearance of a loudspeaker apparatus according to a first embodiment.

FIG. 1 is a perspective view showing an exemplary appearance of a loudspeaker apparatus according to a first embodiment. The loudspeaker apparatus 1 has an enclosure 101 and multiple loudspeaker units provided to the enclosure 101. The enclosure 101 may use a known system such as a bass reflex system, a back-loaded horn system or an acoustic tube system.

The enclosure 101 has an upper face (top face) 102, a bottom face 103 and a side face. For example, each of the upper face 102 and the bottom face 103 has an approximately bombshell shape slightly tapering in width in the depth direction of the loudspeaker apparatus 1. Meanwhile, for example, the side face of the loudspeaker apparatus 1 includes a curved side face 104 having a curved shape and a mounting flat face 105 directed horizontally forward and gradually increased in width in the vertically downward direction. In addition, a flat side face 106 and a flat side face 107 are formed on both sides of the mounting flat face 105 at a predetermined angle with the mounting flat face 105. The mounting flat face 105, the flat side face 106, the curved side face 104 and the flat side face 107 are continuously formed to serve as the side face of the loudspeaker apparatus 1. The loudspeaker apparatus 1 has, as the loudspeaker units configured to reproduce sound, a loudspeaker unit 110 (example of the second loudspeaker unit), a loudspeaker unit 111 (example of the first loudspeaker unit), a loudspeaker unit 112 (example of a third loudspeaker unit) and a loudspeaker unit 113 (example of a fourth loudspeaker unit), for example. The sound include various kinds of sound that are audible to the human ear such as human voice and music.

Each of the loudspeaker units 110 and 111 is provided to the loudspeaker apparatus 1 as a tweeter configured to reproduce high-frequency sound. The term "high frequency" herein means being in a relatively high frequency band within the audible band (from 20 hertz (Hz) to 20 kHz, for example). The loudspeaker units 110 and 111 are configured to reproduce sound including the band of 10 kilohertz (kHz) or more, as an example.

The loudspeaker unit 112 is provided to the loudspeaker apparatus 1 as a standard tweeter. Note that the term "standard" herein has no special meaning other than to indicate that the loudspeaker unit 112 has a diaphragm whose size is approximately the standard diaphragm size for a tweeter. The loudspeaker unit 113 is provided to the loudspeaker apparatus 1 as a woofer. The loudspeaker units 112 and 113 are configured to reproduce sound in a band including lower frequencies than the band of sound reproduced by the loudspeaker units 110 and 111.

The loudspeaker units 111 to 113 are provided in the mounting flat face 105 so as to be vertically aligned. As an example, the loudspeaker units 113, 112 and 111 are provided to be aligned in that order from vertical downward to vertical upward. The loudspeaker units 111 to 113 are placed so as to be directed horizontally forward. Normally, the loudspeaker apparatus 1 is used with the loudspeaker units 111 to 113 directed to a listener.

The loudspeaker unit 110 is provided in the upper face 102. For example, the loudspeaker unit 110 is placed so as to be directed vertically upward to make an approximately 90° angle with the loudspeaker unit 111. More specifically, the loudspeaker unit 110 is provided in the upper face 102 at a position adjacent to the loudspeaker unit 111.

In an embodiment, the loudspeaker units 110 and 111 have diaphragms with the same diameter (effective diameter) and shape as each other. For example, the diaphragm of each of the loudspeaker units 110 and 111 is dome-shaped and has a diameter of 22 millimeters (mm) or less. Note that, in the present example, the diaphragm is described to have a diameter of 19 mm. Alternatively, the diaphragm may have a different shape (ribbon shape, for example) or the like.

The loudspeaker unit 112 has a dome-shaped diaphragm with a diameter of 25 mm, for example. The loudspeaker unit 113 has a corn-shaped diaphragm with a diameter of 13 centimeters (cm), for example.

"Directivity of Loudspeaker Apparatus"

Figure 2:
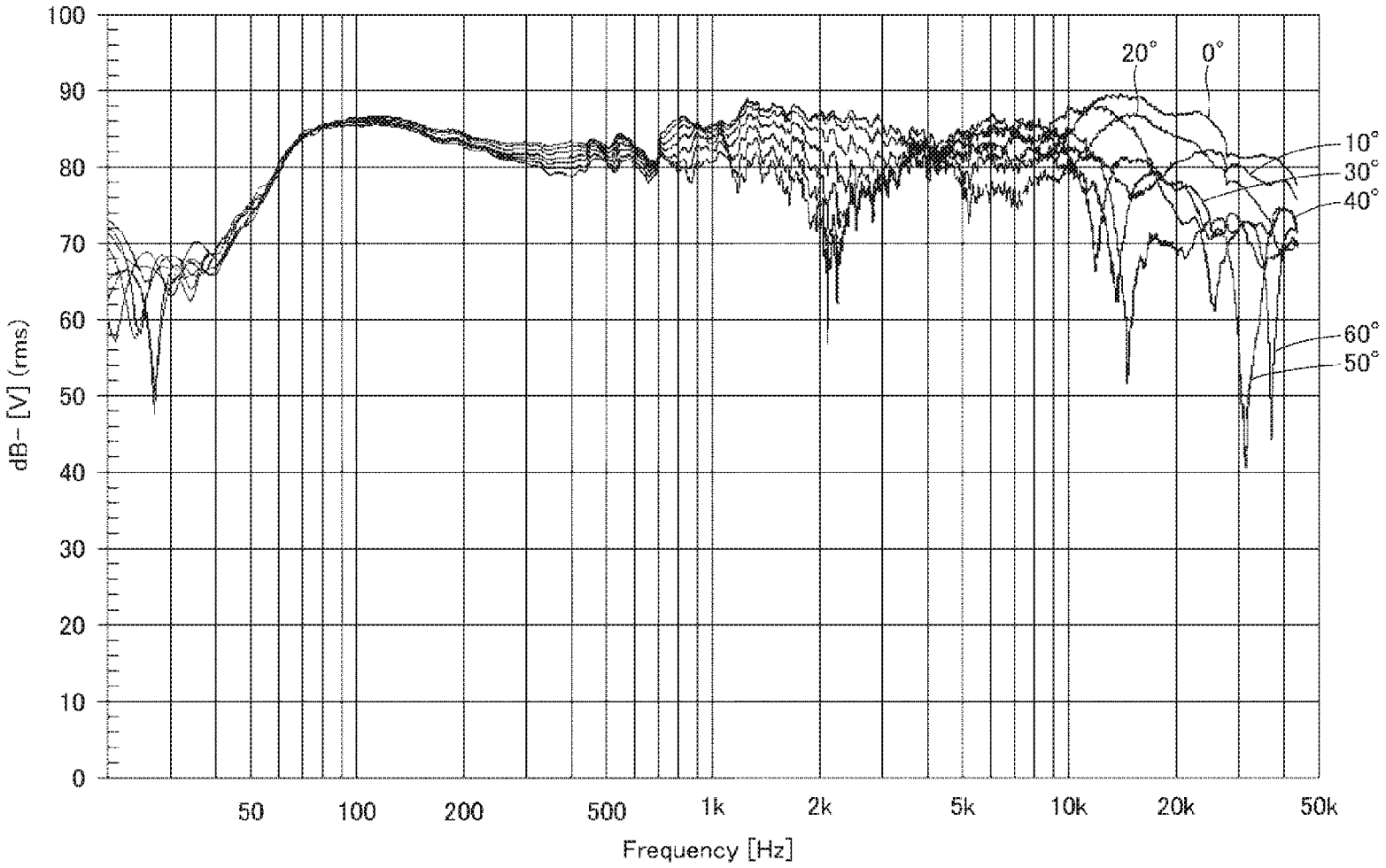
FIG. 2 is a graph showing an exemplary vertical directivity of the loudspeaker apparatus according to the first embodiment.
Figure 3:
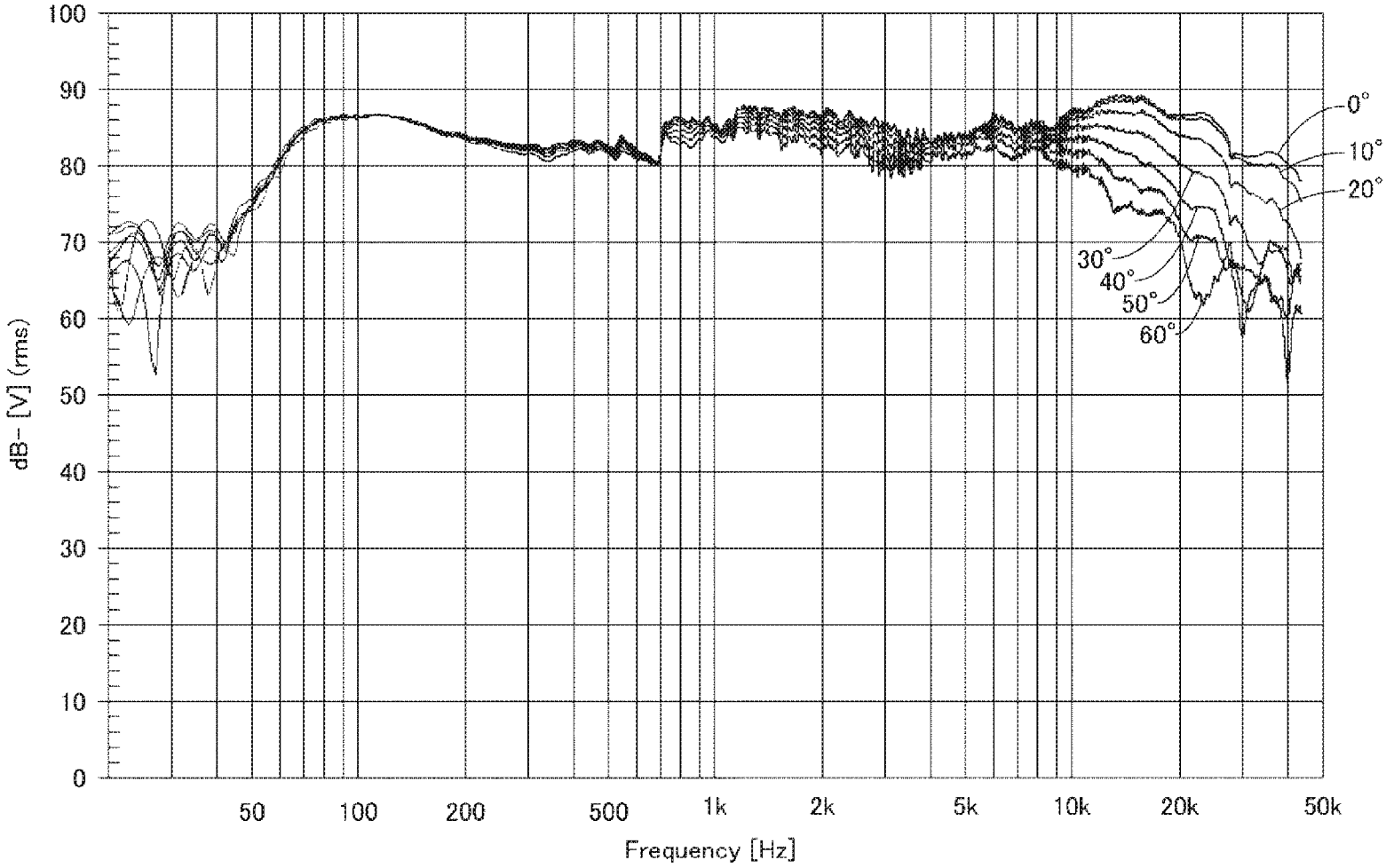
FIG. 3 is a graph showing an exemplary directivity of the loudspeaker apparatus according to the first embodiment.
Figure 4:
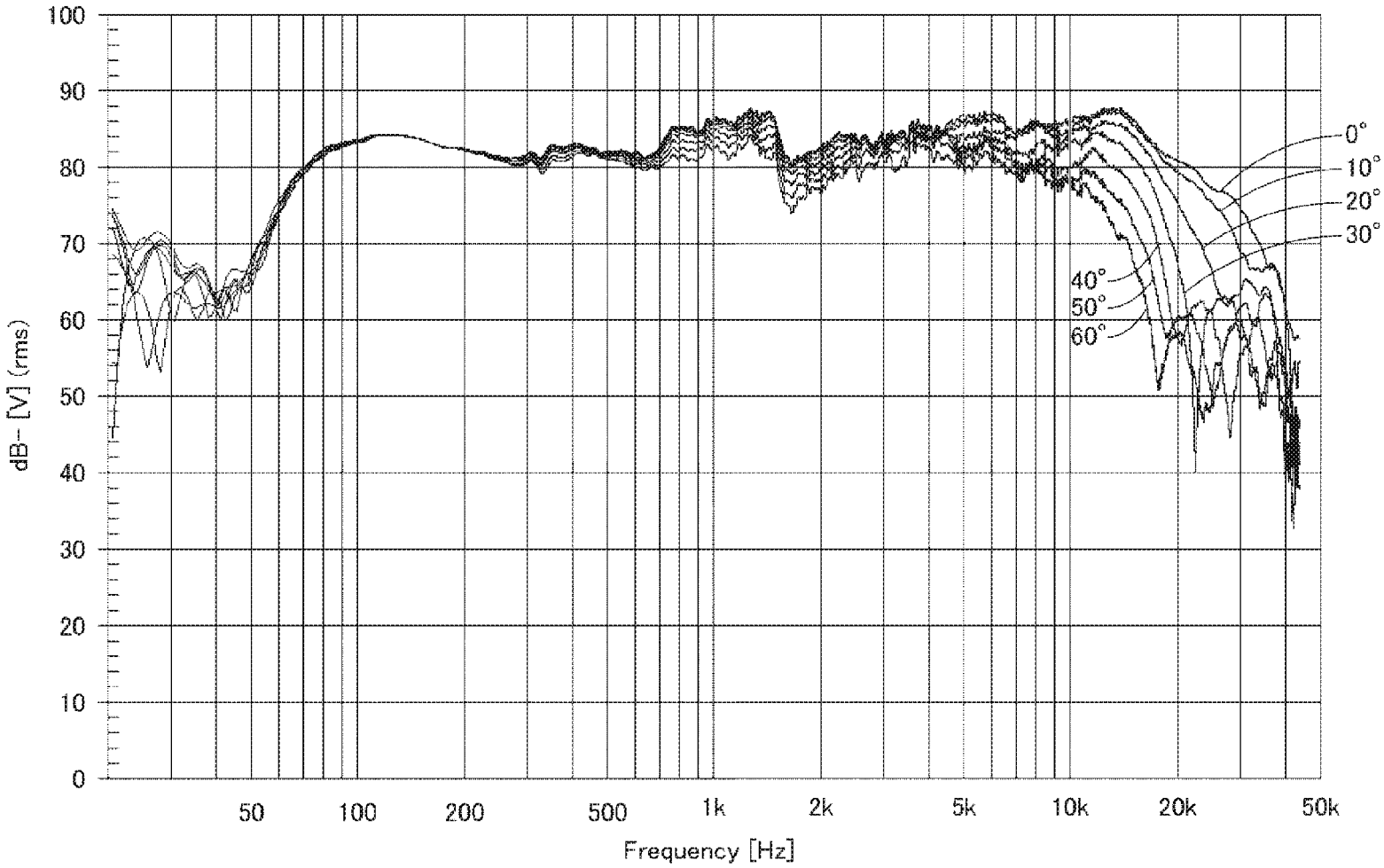
FIG. 4 is a graph showing an exemplary horizontal directivity of a third loudspeaker unit.

FIGS. 2 to 4 are each a graph showing sound pressure levels with respect to frequency. In each graph, the abscissa represents frequency and the ordinate represents a sound pressure level.

FIG. 2 shows sound pressure levels of sound outputted by the loudspeaker apparatus 1 with respect to frequency measured at vertical upward angles of 0° (frontward), 10°, 20°, 30°, 40°, 50° and 60°. FIG. 3 shows sound pressure levels of sound outputted by the loudspeaker apparatus 1 with respect to frequency measured at horizontal angles of 0° (frontward), 10°, 20°, 30°, 40°, 50° and 60°. FIG. 4 shows sound pressure levels of sound outputted only by the loudspeaker unit 112.

As shown in FIG. 4, the sound pressure levels from the loudspeaker unit 112 having a 25 mm diameter diaphragm are significantly reduced when, for example, the frequency is increased to 10 kHz or more. On the other hand, the sound pressure levels from the loudspeaker apparatus 1 using the loudspeaker units 110 and 111 each having a smaller (19 mm, for example) diameter diaphragm are more modestly reduced even when the frequency is increased to 10 kHz or more. This means that using loudspeaker units having smaller diaphragms (having a diameter of 22 mm or less, for example) in the loudspeaker apparatus 1 enables the loudspeaker apparatus 1 to have excellent directivity at high frequencies.

"On Exemplary Network Configuration of Loudspeaker Apparatus"

Figure 5:
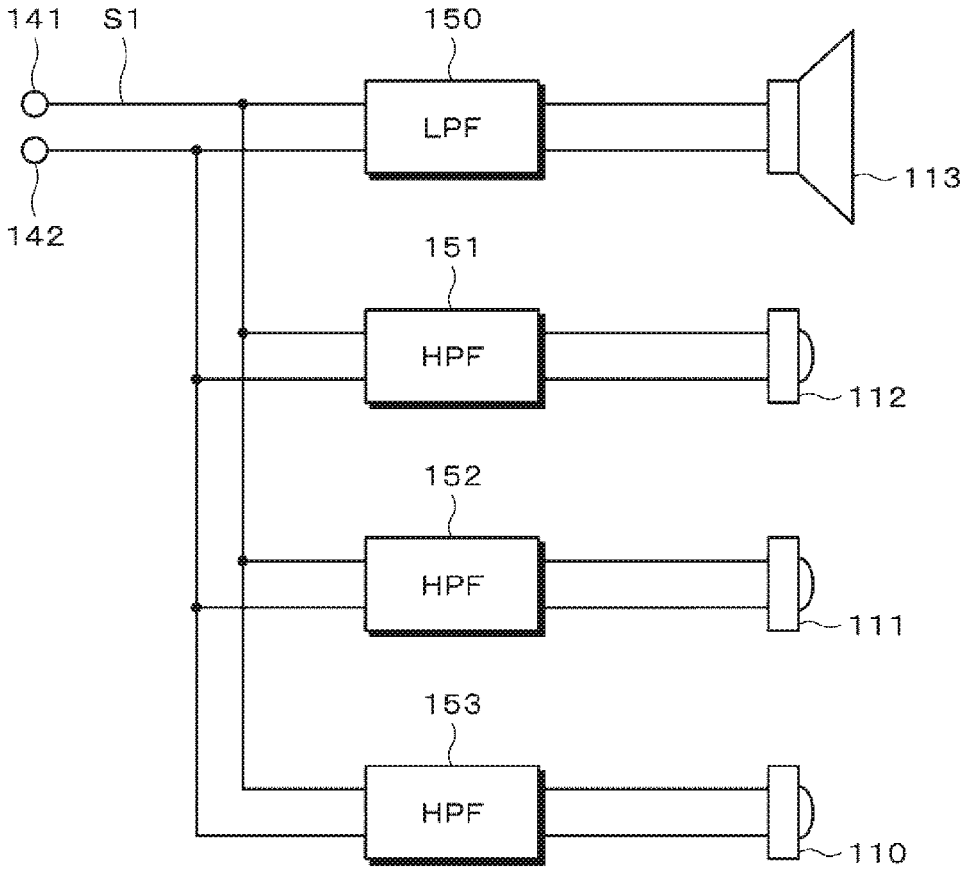
FIG. 5 is a block diagram showing an exemplary network configuration of the loudspeaker apparatus according to the first embodiment.

FIG. 5 shows an exemplary network configuration of the loudspeaker apparatus 1. One of two-channel (LR) sound signals is inputted to a positive terminal 141 and a negative terminal 142, for example. Note that, though not described in detail herein, the sound signal is inputted to the positive terminal 141 and the negative terminal 142 after being subjected to various kinds of known signal processing and amplification processing. The sound signal may be read from a storage medium such as a compact disc (CD) or a hard disk, or may be supplied through a network such as the Internet. Still alternatively, the sound signal may be transferred from a portable reproducing device.

The sound signal inputted to the positive terminal 141 and the negative terminal 142 has a sampling frequency of 44.1 kHz or more and a quantization bit rate of 16 bit or more, for example. Such a sound signal is sometimes referred to as Hi-Res audio (abbreviation for high-resolution audio). Specific examples of the Hi-Res audio signal include a sound signal having a sampling frequency of 96 Hz and a quantization bit rate of 24 bit and a sound signal having a sampling frequency of 192 Hz and a quantization bit rate of 24 bit.

The sound signal S1 inputted to the loudspeaker apparatus 1 is splitted into branches, which are supplied respectively to a low pass filter (LPF) 150, a high pass filter (HPF) 151, a high pass filter 152 and a high pass filter 153.

The low pass filter 150 is connected to the loudspeaker unit 113. The high pass filter 151 is connected to the loudspeaker unit 112. The high pass filter 152, which is an example of a first high pass filter, is connected to the loudspeaker unit 111. The high pass filter 153, which is an example of a second high pass filter, is connected to the loudspeaker unit 110.

Figure 6:
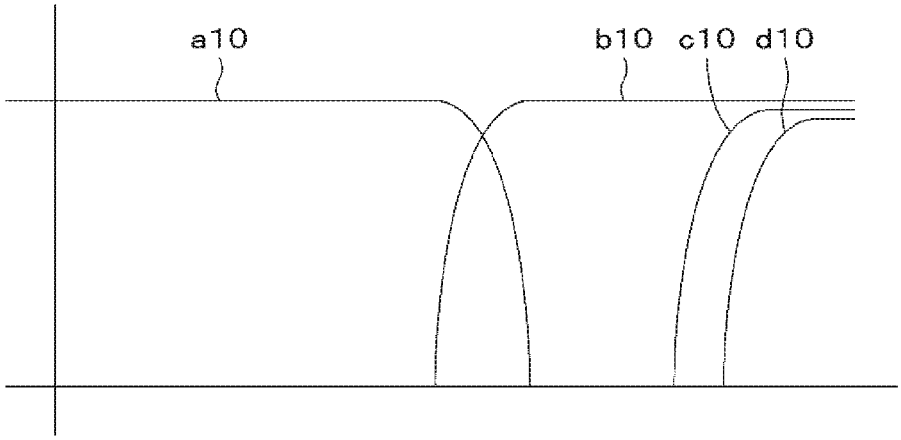
FIG. 6A is a chart for illustrating exemplary characteristics of filters.
FIG. 6B is a chart for illustrating signals having passed through the filters.
Figure 6:
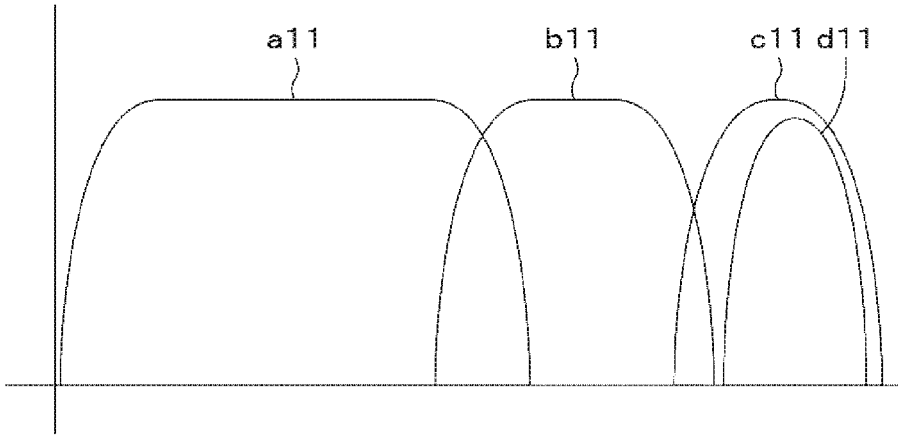

FIG. 6A is a characteristics chart schematically showing characteristics of the filters. In FIG. 6A, the reference signs a10, b10, c10 and d10 represent characteristics of the low pass filter 150, the high pass filter 151, the high pass filter 152 and the high pass filter 153, respectively.

FIG. 6B schematically shows sounds having passed through the filters and reproduced by the loudspeaker units. Note that, in each of FIGS. 6A and 6B, the abscissa represents frequency and the ordinate represents a sound pressure level. In FIG. 6B, the reference signs a11, b11, c11 and d11 represent sounds reproduced by the loudspeaker unit 113, the loudspeaker unit 112, the loudspeaker unit 111 and the loudspeaker unit 110, respectively.

Each filter has a cutoff frequency appropriately set to prevent any drop (dip) in sound pressure level in a specific frequency band. In addition, in the present example, the cutoff frequency of each filter is appropriately set to prevent interference between the loudspeaker units while taking into consideration acoustic energy balance.

For example, the sound pressure level of sound reproduced by the loudspeaker unit 112 drops around 20 kHz, as described above. To address this problem, the cutoff frequency of the high pass filter 152, which is connected to the loudspeaker unit 111, is set to around 20 kHz, or specifically, for example, to 18 kHz. This allows sound outputted by the loudspeaker unit 112 and sound outputted by the loudspeaker unit 111 to be continuous in sound pressure level, thus preventing any drop in sound pressure level from occurring around 20 kHz.

Additionally, in an embodiment, the cutoff frequency of the high pass filter 152 is set different from the cutoff frequency of the high pass filter 153 so that the loudspeaker unit 111 and the loudspeaker unit 110 can have mutually different reproduction bands. For example, the cutoff frequency of the high pass filter 153 is set larger than the cutoff frequency of the high pass filter 152.

For example, at frequencies around 20 kHz, sound reproduced by the loudspeaker unit 111 is reduced in sound pressure level and thus in directivity in an area of vertically upward 45° or more and of horizontal 45° or more. To address this problem, when the cutoff frequency of the high pass filter 152 is set to 18 kHz as described above, the cutoff frequency of the high pass filter 153 is set, for example, to 22 kHz. This enables sound reproduced by the loudspeaker unit 110 to supplement acoustic energy in a band where the directivity of the loudspeaker unit 111 is reduced. In addition, causing the loudspeaker unit 111 and the loudspeaker unit 110 to have mutually different reproduction bands prevents interference between the loudspeaker units 111 and 110, thus preventing deterioration in sound quality.

Moreover, causing the loudspeaker unit 110 and the loudspeaker unit 111 to have mutually different reproduction bands can prevent significant impedance drop of the loudspeaker apparatus 1 in which the loudspeaker unit 110 and the loudspeaker unit 111 are driven in parallel.

Note that a band pass filter (BPF) may alternatively be connected to the loudspeaker unit 112. However, causing a sound signal to pass through a band pass filter leads to phase rotation and thus phase shift of the sound signal. To prevent this, it is preferable to connect a high pass filter to the loudspeaker unit 112.

"Exemplary Placing Positions of Loudspeaker Units"

Hereinafter, description will be given to a preferable placing position of the loudspeaker unit 110 relative to the position of the loudspeaker unit 111. The loudspeaker units 110 and 111 are placed on a plane having an axis extending in a horizontal direction of the loudspeaker apparatus 1 and an axis extending in a vertical direction of the loudspeaker apparatus 1. Assume here that a predetermined point of the loudspeaker unit 111 is placed at the origin of this plane. As an example, the center of a fixing face (diaphragm fixing face), to which the diaphragm is fixed, of the loudspeaker unit 111 is placed at the origin of this plane.

Figure 7:
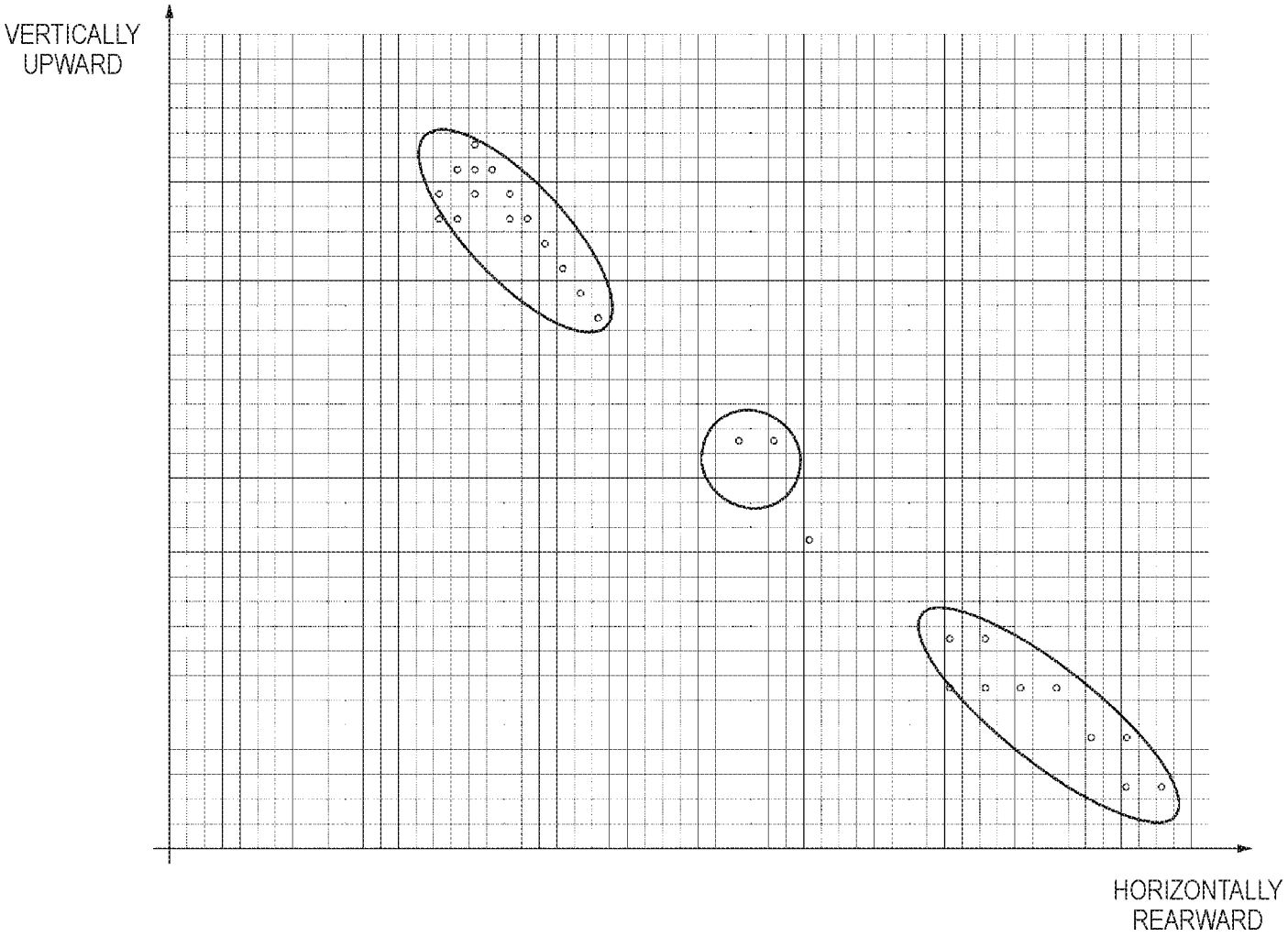
FIG. 7 is a chart for illustrating preferable placing positions of a second loudspeaker unit.

A sound listening test was conducted while the position of the loudspeaker unit 110 was shifted but the position of the loudspeaker unit 111 was fixed. FIG. 7 shows results of the test. The loudspeaker unit 110 was placed at a position on a vertically upward side and on a horizontally rearward side to the loudspeaker unit 111. Each rectangular frame represents a test position of the loudspeaker unit 110, and the rectangles enclosed by ○ represent preferable positions of the loudspeaker unit 110 for listening. As shown in FIG. 7, the positions of the loudspeaker unit 110 that are determined as preferable for listening gather in certain areas. Note that "preferable for listening" means allowing high-frequency sound to be listened to with certain clarity, for example.

Figure 8:
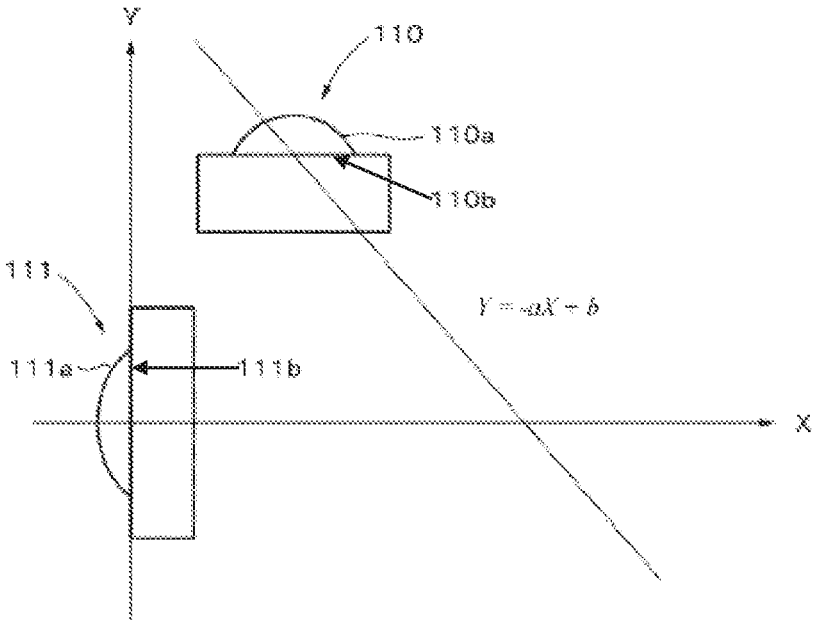
FIG. 8 is a chart for illustrating preferable placing positions of the second loudspeaker unit.

FIG. 8 shows a linear approximation graph of the positions of the loudspeaker unit 110 that are determined as preferable for listening. The graph is in a plane where the X-axis extends horizontally rearward and the Y-axis extends vertically upward under the same assumption as above. In FIG. 8, the diaphragm and the diaphragm fixing face of the loudspeaker unit 111 are schematically represented by the reference signs 111*a* and 111*b*, respectively. Meanwhile, the diaphragm and the diaphragm fixing face of the loudspeaker unit 110 are schematically represented by the reference signs 110*a* and 110*b*, respectively.

The positions of the loudspeaker unit 110 that are determined as preferable for listening can be approximated by the following Formula (1), for example.

$$Y=-aX+b(\text{where } a>0, b>0, X>0, Y>0) \quad (1)$$

The positions of the loudspeaker unit 110 defined by Formula (1) are both vertically upwardly and horizontally rearwardly close to the position of the loudspeaker unit 111. Preferably, the values for a and b in Formula (1) are set within the following ranges where a and b are in units of millimeters.

$0.85 \leq a \leq 1.9$ $46 \leq b \leq 105$

As described above, the loudspeaker apparatus 1 according to this embodiment can clearly reproduce high-frequency sound and can provide a larger listening area for high-frequency sounds. This allows the loudspeaker apparatus according to this embodiment to work even in such situations as listening to sound while doing other works (doing housework in standing positions, for example), and listening to sound at a position out of a frontward area of the loudspeaker apparatus.

As described above, adding an upwardly directed, small, high-directivity tweeter loudspeaker unit can improve directivity. In addition, the upwardly directed tweeter loudspeaker unit can supplement high-frequency acoustic energy, enabling a listening room to be filled with acoustic energy in all frequency bands with good balance.

On the other hand, placing multiple loudspeaker units configured to reproduce the same band as each other might cause problematic sound signal interference between the loudspeaker units. However, placing the loudspeaker units at the appropriate positions as described in the above embodiment can prevent or reduce such interference between the loudspeaker units. In addition, such placement improves sound spread from the loudspeaker apparatus, thus expanding an area of listening positions. For example, when reproducing high-quality audio such as Hi-Res audio, the loudspeaker apparatus makes it possible to enjoy listening to the music in an area expanded even to positions out of a frontward area of the loudspeaker apparatus.

2. Second Embodiment

Next, a second embodiment will be described. Note that the matters that has been described in the first embodiment are applicable to the second embodiment without causing any technical contradiction.

Figure 9:
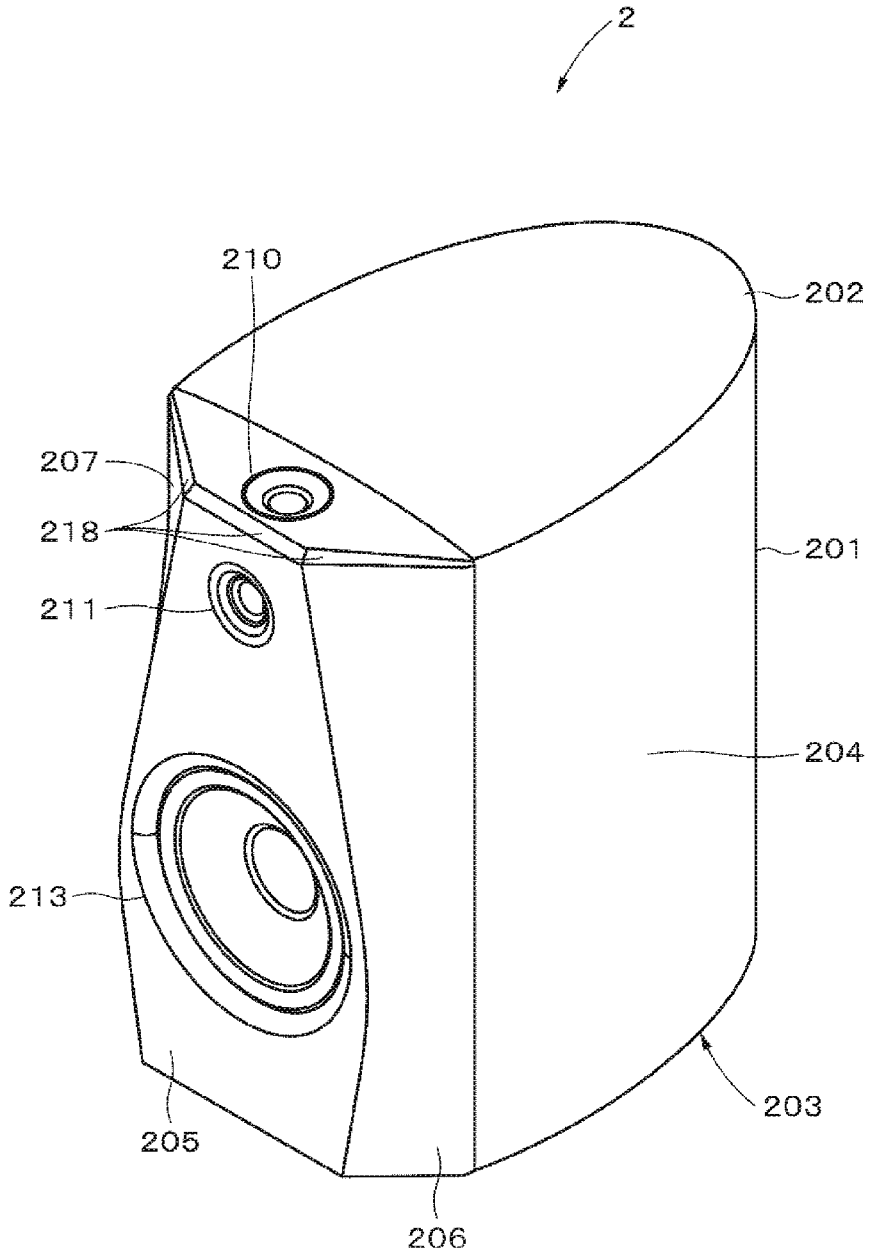
FIG. 9 is a perspective view showing an exemplary appearance of a loudspeaker apparatus according to a second embodiment.

FIG. 9 is a perspective view showing an exemplary appearance of a loudspeaker apparatus according to a second embodiment. The loudspeaker apparatus 2 has an enclosure 201 and multiple loudspeaker units provided to the enclosure 201. The enclosure 201 has approximately the same shape as the enclosure 201 of the loudspeaker apparatus 1, and may use a known system such as a bass reflex system, a back-loaded horn system or an acoustic tube system.

The enclosure 201 has an upper face 202, a bottom face 203 and a side face. For example, each of the upper face 202 and the bottom face 203 has an approximately bombshell shape slightly tapering in width in the depth direction of the loudspeaker apparatus 2. Meanwhile, for example, the side face of the loudspeaker apparatus 2 includes a curved side face 204 having a curved shape and a mounting flat face 205 directed horizontally forward and gradually increased in width in the vertically downward direction. In addition, a flat side face 206 and a flat side face 207 are formed on both sides of the mounting flat face 205 at a predetermined angle with the mounting flat face 205. The mounting flat face 205, the flat side face 206, the curved side face 204 and the flat side face 207 are continuously formed to serve as the side face of the loudspeaker apparatus 2.

The loudspeaker apparatus 2 has, as the loudspeaker units configured to reproduce sounds, a loudspeaker unit 210, a loudspeaker unit 211 and a loudspeaker unit 213, for example.

Each of the loudspeaker units 210 and 211 is provided to the loudspeaker apparatus 2 as a tweeter configured to reproduce high-frequency sound. The loudspeaker unit 210 is a component corresponding to the loudspeaker unit 210 in the first embodiment, while the loudspeaker unit 211 is a component corresponding to the loudspeaker unit 211 in the first embodiment.

The loudspeaker unit 211 is provided to the loudspeaker apparatus 2 as a loudspeaker configured to reproduce full-range sound. The loudspeaker unit 211 has a 10 cm diaphragm, for example.

"On Exemplary Network Configuration of Loudspeaker Apparatus"

Figure 10:
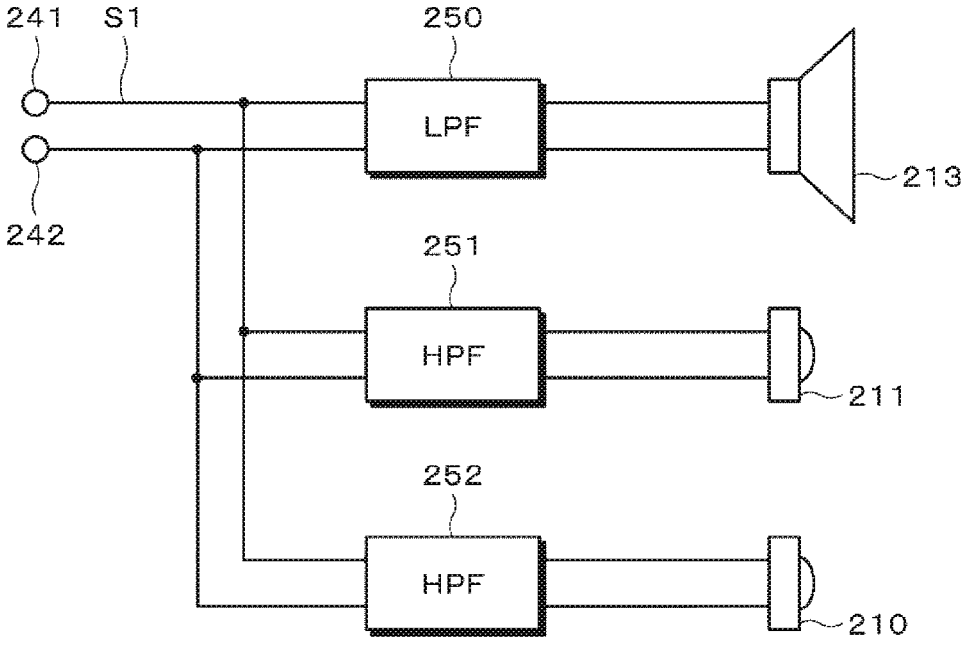
FIG. 10 is a block diagram showing an exemplary network configuration of the loudspeaker apparatus according to the second embodiment.

FIG. 10 shows an exemplary network configuration of the loudspeaker apparatus 2. One of two-channel (LR) stereo sound signals is inputted to a positive terminal 241 and a negative terminal 242, for example. Note that the sound signal is inputted to the positive terminal 241 and the negative terminal 242 after being subjected to various kinds of known signal processing and amplification processing.

The sound signal S1 inputted to the loudspeaker apparatus 2 is splitted into branches, which are supplied respectively to a low pass filter 250, a high pass filter 251 and a high pass filter 252.

The low pass filter 250 is connected to the loudspeaker unit 213. The high pass filter 251 is connected to the loudspeaker unit 211. The high pass filter 252 is connected to the loudspeaker unit 210.

Figure 11:
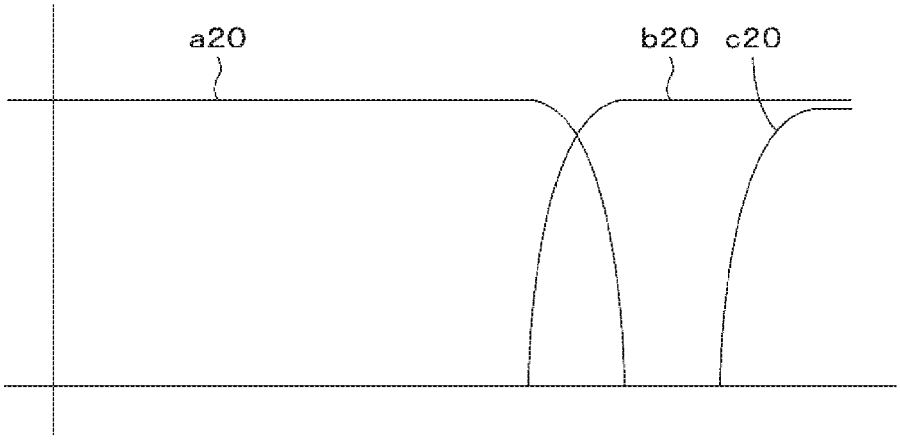
FIG. 11A is a chart for illustrating exemplary characteristics of filters.
FIG. 11B is a chart for illustrating signals having passed through the filters.
Figure 11:
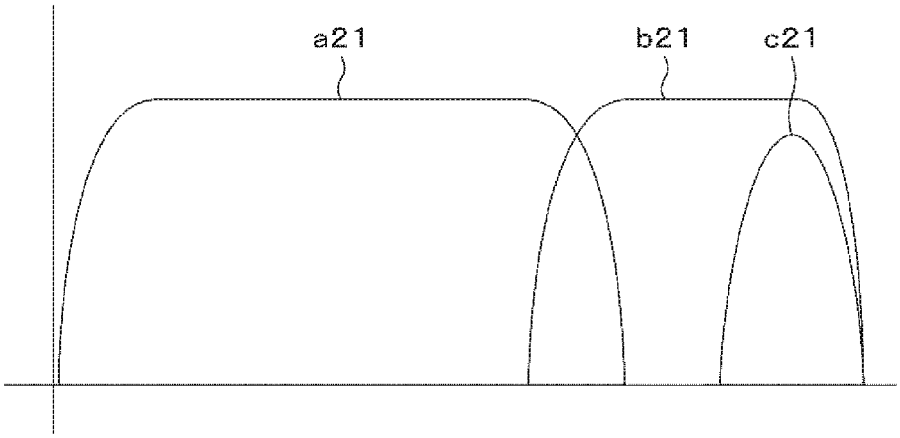

FIG. 11A is a characteristics chart schematically showing characteristics of the filters. In FIG. 11A, the reference signs a20, b20 and c20 represent characteristics of the low pass filter 250, the high pass filter 251 and the high pass filter 252, respectively.

FIG. 11B schematically shows sounds having passed through the filters and reproduced by the loudspeaker units. Note that, in each of FIGS. 11A and 11B, the abscissa represents frequency and the ordinate represents sound pressure level. In FIG. 11B, the reference signs a21, b21 and c21 represent sounds reproduced by the loudspeaker unit 213, the loudspeaker unit 211 and the loudspeaker unit 210, respectively.

Each filter has a cutoff frequency appropriately set to prevent any drop (dip) in sound pressure level in a specific frequency band. For example, the cutoff frequency of the high pass filter 251 is set to a value near the frequency band in which sound having passed through the low pass filter 250 drops in sound pressure level. This allows sound outputted by the loudspeaker unit 213 and sound outputted by the loudspeaker unit 111 to be continuous in sound pressure level.

In addition, the cutoff frequency of each filter is appropriately set to prevent interference between the loudspeaker units 210 and 211 while supplementing acoustic energy in a band where the directivity of the loudspeaker unit 213 is reduced. Moreover, the cutoff frequency of the high pass filter 251 is set different from the cutoff frequency of the high pass filter 252 so that the loudspeaker unit 211 and the loudspeaker unit 210 can have mutually different reproduction bands. For example, the cutoff frequency of the high pass filter 252 is set larger than the cutoff frequency of the high pass filter 251.

Causing the loudspeaker unit 210 and the loudspeaker unit 211 to have mutually different reproduction bands can prevent significant impedance drop of the loudspeaker apparatus 2 in which the loudspeaker unit 210 and the loudspeaker unit 211 are driven in parallel.

As described above, the number and the like of the loudspeaker units provided to the loudspeaker apparatus may be changed as appropriate.

3. Modification

Hereinabove, specific description has been given of the multiple embodiments according to the present disclosure. However, the present disclosure is not limited to the above multiple embodiments, and various modifications based on the technical concept of the present disclosure may be made.

In the loudspeaker apparatus in each of the above embodiments, the peripheral edge of the upper face may be partially cut off at approximately 45° to form one or more inclined faces. For example, an inclined face 118 (see FIG. 1) may be formed between the upper face 102 and the mounting flat face 105 by cutting off the edge at approximately 45° with respect to the upper face 102 and the mounting flat face 105. In addition, another inclined face 118 may be formed between the upper face 102 and each of the flat side faces 106 and 107 by cutting off the edge at approximately 45° with respect to the upper face 102 and each flat side face. Such inclined faces formed as above are sometimes referred to as C chamfers.

Forming an inclined face can reduce baffle diffraction, thus preventing degradation in sound quality such as lack of sound clarity. Note that such inclined faces may be formed in the loudspeaker apparatus in the second embodiment.

In the first embodiment (or second embodiment) described above, the loudspeaker unit 110 may be configured to reproduce sound lower in sound pressure level than sound reproduced by the loudspeaker unit 111.

One or more protrusions and recesses may be provided in the mounting flat face of the loudspeaker apparatus so that the loudspeaker units can be provided at the protrusions and recesses.

The present disclosure can be embodied not only as an apparatus but also as a method, a program, a system or the like. Such a program can be provided to users through a network or in portable memory such as an optical disk or semiconductor memory, for example.

Note that the components and the processing steps in the embodiments and the modification can be combined as appropriate without causing any technical contradiction. The order of the processing steps in each of the processing flows described as examples may be changed as appropriate without causing any technical contradiction.

Additionally, the present technology may also be configured as below.

(1)

A loudspeaker apparatus including:

a first loudspeaker unit and a second loudspeaker unit that are configured to reproduce sound at least at a high frequency, wherein the first loudspeaker unit and the second loudspeaker unit are placed on a plane having an axis extending in a horizontal direction and an axis extending in a vertical direction, wherein the first loudspeaker unit is placed so as to be directed horizontally forward, wherein the second loudspeaker unit is placed so as to be directed vertically upward to make an approximately 90° angle with the first loudspeaker unit, and wherein, when a center of a diaphragm fixing face of the first loudspeaker unit is placed at an origin of the plane, and it is assumed that X represents a horizontally rearward direction and Y represents a vertically upward direction, the second loudspeaker unit is placed in a manner that coordinates of a center of a diaphragm fixing face of the second loudspeaker unit lie on a straight line represented by the following formula in the plane:

$$Y=-aX+b, \text{ where } a>0, b>0, X>0, \text{ and } Y>0. \quad \text{(Formula)}$$

(2)

The loudspeaker apparatus according to (1), including:

a first high pass filter connected to the first loudspeaker unit; and a second high pass filter connected to the second loudspeaker unit, wherein the first high pass filter has a cutoff frequency set to a value different from a cutoff frequency of the second high pass filter.

(3)

The loudspeaker apparatus according to (2), wherein the cutoff frequency of the second high pass filter is set to a value larger than the cutoff frequency of the first high pass filter.

(4)

The loudspeaker apparatus according to any of (1) to (3), wherein values for a and b in the formula are set within the following ranges:

$0.85 \leq a \leq 1.9$, and $46 \leq b \leq 105$ (unit:millimeter).

(5)

The loudspeaker apparatus according to any of (1) to (4), wherein the first loudspeaker unit and the second loudspeaker unit have diaphragms with a same effective diameter and a same shape as each other.

(6)

The loudspeaker apparatus according to (5), wherein each of the first loudspeaker unit and the second loudspeaker unit has a dome-shaped diaphragm with an effective diameter of 22 mm or less.

(7)

The loudspeaker apparatus according to any of (1) to (6), wherein the first loudspeaker unit and the second loudspeaker unit are configured to reproduce sound including a band of 10 kHz or more.

(8)

The loudspeaker apparatus according to any of (1) to (7), including:

a third loudspeaker unit and a fourth loudspeaker unit that are configured to reproduce sound including a lower frequency than a band of sound reproduced by the first loudspeaker unit and the second loudspeaker unit, wherein the third loudspeaker unit and the fourth loudspeaker unit are placed so as to be vertically aligned with the first loudspeaker unit.

(9)

The loudspeaker apparatus according to any of (1) to (8), wherein an inclined face is formed between a first face where the first loudspeaker unit is placed and a second face where the second loudspeaker is placed by cutting off an edge at approximately 45° with respect to the first face and the second face.

REFERENCE SIGNS LIST

1, 2 loudspeaker apparatus
110, 111, 112, 113 loudspeaker unit
152, 153 high pass filter
110*b*, 111*b* diaphragm fixing face

The invention claimed is:

1. A loudspeaker apparatus, comprising:

a first loudspeaker and a second loudspeaker that are configured to reproduce sound at least at a first frequency of more than 10 kHz;

a first high pass filter directly coupled to the first loudspeaker;

a second high pass filter directly coupled to the second loudspeaker;

a first face having a width that gradually increases in a vertically downward direction;

a second face perpendicular to the first face;

a first side face on a first side of the first face, wherein the first side face is inclined at a specific angle with respect to the first face;

a second side face on a second side of the first face, wherein the second side face is inclined at the specific angle with respect to the first face;

a first inclined face between the second face and the first face, wherein the first inclined face is inclined at 45° with respect to the first face and the second face;

a second inclined face between the second face and the first side face, wherein the second inclined face is inclined at 45° with respect to the second face and the first side face;

a third inclined face between the second face and the second side face, wherein the third inclined face is inclined at 45° with respect to the second face and the second side face; and a curved side face with a curved shape, wherein each of the first side face, the second side face, and the curved side face is perpendicular to the second face, the first loudspeaker is on the first face of the loudspeaker apparatus, the second loudspeaker is on the second face of the loudspeaker apparatus, a position of the second loudspeaker is horizontally rearward with respect to the first loudspeaker, and vertically upward with respect to the first loudspeaker, a cutoff frequency of the second high pass filter is greater than a cutoff frequency of the first high pass filter, a reproduction band of the first loudspeaker and a reproduction band of the second loudspeaker are based on the cutoff frequency of the first high pass filter and the cutoff frequency of the second high pass filter, a part of the reproduction band of the first loudspeaker is different from a part of the reproduction band of the second loudspeaker such that an interference between the first loudspeaker and the second loudspeaker is prevented, and each of the first loudspeaker and the second loudspeaker has a diaphragm with a same diameter that is one of less than or equal to 22 mm.

2. The loudspeaker apparatus according to claim 1, wherein the first loudspeaker has a first diaphragm fixing face and the second loudspeaker has a second diaphragm fixing face, a center of the first diaphragm fixing face is at an origin of a plane, the plane is represented by an X-axis and a Y-axis, a center of the second diaphragm fixing face lies on a straight line, the straight line is represented by the following formula in the plane:

$$Y=-aX+b, \text{ where } 0.85\leq a\leq 1.9,\ 46\leq b\leq 105,\ X>0, \text{ and } Y>0 \text{ (unit:millimeter), and} \quad \text{(Formula)}$$

X represents a first direction along the X-axis in the plane and Y represents a second direction along the Y-axis in the plane.

3. The loudspeaker apparatus according to claim 1, wherein the diaphragm of each of the first loudspeaker and the second loudspeaker has a same shape.

4. The loudspeaker apparatus according to claim 3, wherein each of the first loudspeaker and the second loudspeaker has a dome-shaped diaphragm.

5. The loudspeaker apparatus according to claim 1, further comprising:

a third loudspeaker and a fourth loudspeaker that are configured to reproduce sound at a second frequency lower than the first frequency, wherein each of the third loudspeaker and the fourth loudspeaker is vertically aligned with respect to the first loudspeaker.

* * * * *